US006152411A

United States Patent [19]

Lundstrom

[11] Patent Number: 6,152,411

[45] Date of Patent: Nov. 28, 2000

[54] COMPUTER KEYBOARD TRAY

[75] Inventor: Donald A. Lundstrom, Worcester, Mass.

[73] Assignee: ModuForm, Inc., Fitchburg, Mass.

[21] Appl. No.: 09/266,099

[22] Filed: Mar. 10, 1999

Related U.S. Application Data

[60] Provisional application No. 60/079,327, Mar. 25, 1998.

[51] Int. Cl.[7] ..... E04G 3/00

[52] U.S. Cl. ..... 248/291.1; 248/118.1; 16/320; 16/392

[58] Field of Search ..... 248/291.1, 118, 248/118.1, 918; 108/143, 102, 69; 16/392, 320, 389, 235, 237; 312/208.3, 208.1, 248.4, 298, 327, 328

[56] References Cited

U.S. PATENT DOCUMENTS

| | | | |
|---|---|---|---|
| D. 344,652 | 3/1994 | Hatcher | D6/511 |
| 486,474 | 11/1892 | Jones | 312/205 |
| 487,150 | 11/1892 | Ohmer | 312/323 |
| 1,009,251 | 11/1911 | Lippincott | 16/392 |
| 2,904,380 | 9/1959 | Mark | 312/27 |
| 2,938,227 | 5/1960 | Lhota | 16/392 |
| 3,016,563 | 1/1962 | Jong | 16/320 |
| 3,152,716 | 10/1964 | Feldhahn | 220/31 |
| 3,287,760 | 11/1966 | Moore | 16/171 |
| 3,389,424 | 6/1968 | Fellwock | 16/392 |
| 3,439,377 | 4/1969 | Bucholz | 16/389 |
| 3,562,850 | 2/1971 | Eliason et al. | 16/320 |
| 4,332,053 | 6/1982 | Salice | 16/370 |
| 4,434,524 | 3/1984 | Gilchrist | 16/250 |
| 4,505,502 | 3/1985 | Tomita | 292/251.5 |
| 4,709,972 | 12/1987 | LaBudde et al. | 312/208.3 |
| 4,788,964 | 12/1988 | Dorsey et al. | 126/299 R |
| 4,923,259 | 5/1990 | Bartok | 312/223.2 |
| 4,931,978 | 6/1990 | Drake et al. | 361/680 |
| 5,062,609 | 11/1991 | Hames et al. | 248/676 |
| 5,175,908 | 1/1993 | Domenig | 16/237 |
| 5,205,631 | 4/1993 | Wegman et al. | 312/348.3 |
| 5,273,250 | 12/1993 | Pemberton et al. | 108/5 |
| 5,377,951 | 1/1995 | Johnson et al. | 248/639 |
| 5,456,506 | 10/1995 | Bartlett | 292/281 |
| 5,487,525 | 1/1996 | Drabsczyk et al. | 248/639 |
| 5,496,104 | 3/1996 | Arnold et al. | 312/204 |
| 5,524,323 | 6/1996 | Lin | 16/235 |
| 5,566,843 | 10/1996 | Kruska | 211/104 |
| 5,595,428 | 1/1997 | Huang | 312/223.2 |
| 5,603,142 | 2/1997 | Dubach et al. | 16/247 |
| 5,611,112 | 3/1997 | Rock et al. | 16/237 |
| 5,611,113 | 3/1997 | Rock et al. | 16/246 |
| 5,626,323 | 5/1997 | Lechman et al. | 248/286.1 |
| 5,651,594 | 7/1997 | Lechman | 312/194 |
| 5,704,698 | 1/1998 | Lin | 312/208.1 |
| 5,826,305 | 10/1998 | Domenig et al. | 16/235 |
| 5,930,866 | 8/1999 | Rupprechter | 16/242 |
| 6,049,946 | 4/2000 | Cress et al. | 16/240 |

OTHER PUBLICATIONS

18–8 Stainless Steel Cabinet Pivot Hinges, McMaster–Carr Catalog, at least by Mar. 5, 1998.

*Primary Examiner*—Anita M. King
*Assistant Examiner*—Naschica C Sanders
*Attorney, Agent, or Firm*—Hamilton, Brook, Smith & Reynolds, PC

[57] ABSTRACT

A keyboard tray assembly includes a tray having a front end and a bottom wall with an upper surface. A front wall is rotatably secured to the front end of the tray by a first hinge. The front wall is rotatable between an up position and a down position. The first hinge has first and second hinge members which are rotatably coupled together about a pivot point. The first hinge member is secured to the tray and the second hinge member is secured to the front wall. The first hinge is shaped to position the pivot point adjacent to the front end of the tray below the upper surface of the bottom wall and within a first recess in the front wall. This allows the front wall to pivot in close relationship to the front end of the tray.

25 Claims, 7 Drawing Sheets

COMPUTER KEYBOARD TRAY

RELATED APPLICATION

This application claims the benefit of U.S. provisional application Ser. No. 60/079,327, filed on Mar. 25, 1998, the entire teachings of which are incorporated herein by reference.

BACKGROUND

Some desks are specifically designed for computers and include a shallow sliding tray or drawer for storing the keyboard below the desktop. The tray is designed to slide outwardly to a position in front of the desk so that the user can access the keyboard when operating the computer. Some trays contain a pivoting front wall that can be raised into an upright position or lowered into a horizontal position. When the tray is positioned under the desktop for storing the keyboard, the front wall is typically pivoted into the upright position to hide the keyboard. When the tray is slid outwardly into a position in front of the desk for accessing the keyboard, the front wall is typically pivoted downwardly into the horizontal position in front of the keyboard to act as a handrest.

FIGS. 1 and 2 depict the typical prior art method of pivotably securing a front wall to a keyboard tray. Keyboard tray 100 includes a bottom wall 102 and three side walls 108. The front wall 106 is mounted to the bottom wall 102 of tray 100 with a pair of standard hinges 104. The hinges 104 are usually spaced apart from each other. One hinge member 104*a* of each hinge 104 is mounted to the upper surface of bottom wall 102 and the other hinge member 104*b* is mounted to the inner surface of front wall 106. FIG. 1 depicts front wall 106 in an upright position and FIG. 2 depicts front wall 106 in a horizontal position. A drawback of this design is that a large gap 110 extends between the front wall 106 and the bottom wall 102 due to the location of the pivot 104*c* of the hinges 104. This gap 110 is usually large enough such that objects the size of a pencil can fall through the gap 110 which can be a nuisance to the user. In addition, as can be seen in FIG. 2, exposed edges of pivot 104*c* as well as hinge members 104*a*/104*b* on the bottom wall 102 and the front wall 106 are in areas that could cause injury to the user of the computer by scraping or scratching the user's hands or wrists.

SUMMARY OF THE INVENTION

The present invention is directed to a keyboard tray assembly which addresses the problems in the prior art discussed above. The keyboard tray assembly of the present invention includes a tray having a front end and a bottom wall with an upper surface. A front wall is rotatably secured to the front end of the tray by a first hinge. The front wall is rotatable between an up position and a down position. The first hinge has first and second hinge members which are rotatably coupled together about a pivot point. The first hinge member is secured to the tray and the second hinge member is secured to the front wall. The first hinge is shaped to position the pivot point adjacent to the front end of the tray below the upper surface of the bottom wall and within a first recess in the front wall. This allows the front wall to pivot in close relationship to the front end of the tray, thereby minimizing the gap therebetween.

In preferred embodiments, the tray has a first side wall. The first hinge member has a mounting surface which is secured to the interior surface of the first side wall and the second hinge member has a mounting surface at a right angle to the mounting surface of the first hinge member which is secured to the interior surface of the front wall adjacent to the first recess. In addition, the first and second hinge members each have a pivot arm portion extending below the upper surface of the bottom wall into the first recess of the front wall. The arms are rotatably coupled together about the pivot point. The front end of the tray acts as a stop for the front wall when the front wall is lowered into the down position. A latching member latches the front wall in the up position and includes a magnet secured to the first side wall at the front end of the tray for magnetically engaging the second hinge member. In one preferred embodiment, the magnet is secured to the top of the first side wall. In another preferred embodiment, the magnet is secured within the front end of the first side wall.

Typically, the tray assembly includes a second side wall opposite to the first side wall and a second hinge spaced apart from the first hinge. The second hinge has first and second hinge members rotatably coupled together about a pivot point. The first hinge member of the second hinge is secured to the second side wall and the second hinge member of the second hinge is secured to the front wall. The second hinge is shaped to position the pivot point of the second hinge adjacent to the front end of the tray below the upper surface of the bottom wall and within a second recess in the front wall.

By mounting the first and second hinges to the side walls of the tray instead of to the bottom wall, there are no hinge members on the bottom wall of the tray on which the user can injure his/her hands or wrists. In addition, the second hinge members of the first and second hinges are secured to the front wall at locations beyond the effective work space of the user and, therefore, present little risk of injury. Finally, the pivot points are hidden within the recesses of the front wall.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
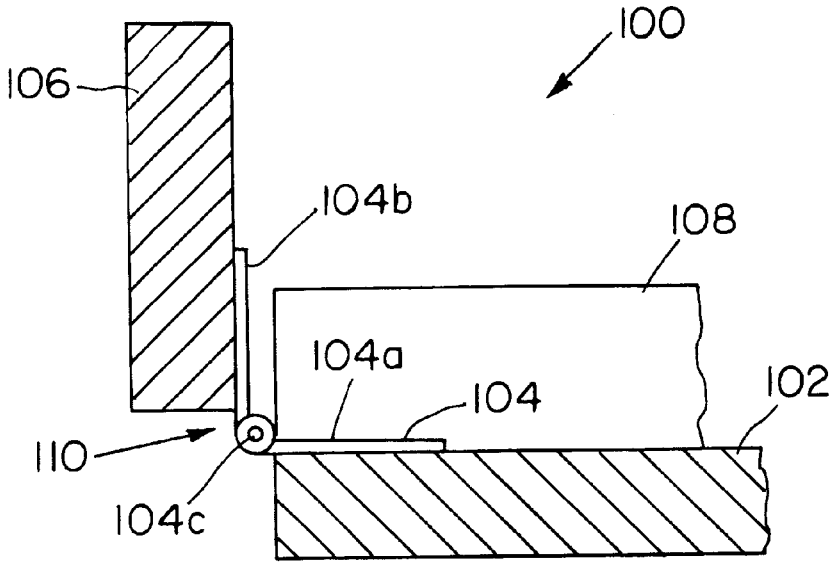
FIG. 1 PRIOR ART
FIG. 1 is a side-sectional view of a prior art keyboard tray with the front wall in the upright position.
Figure 2:
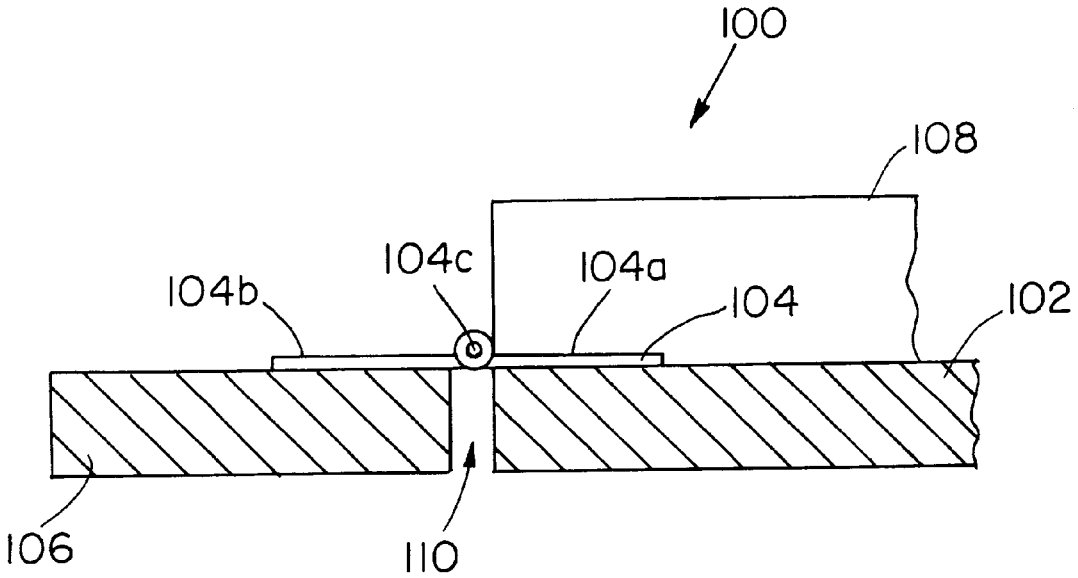
FIG. 2 PRIOR ART
FIG. 2 is a side-sectional view of the prior art keyboard tray of FIG. 1 with the front wall lowered into a horizontal position.
Figure 3:
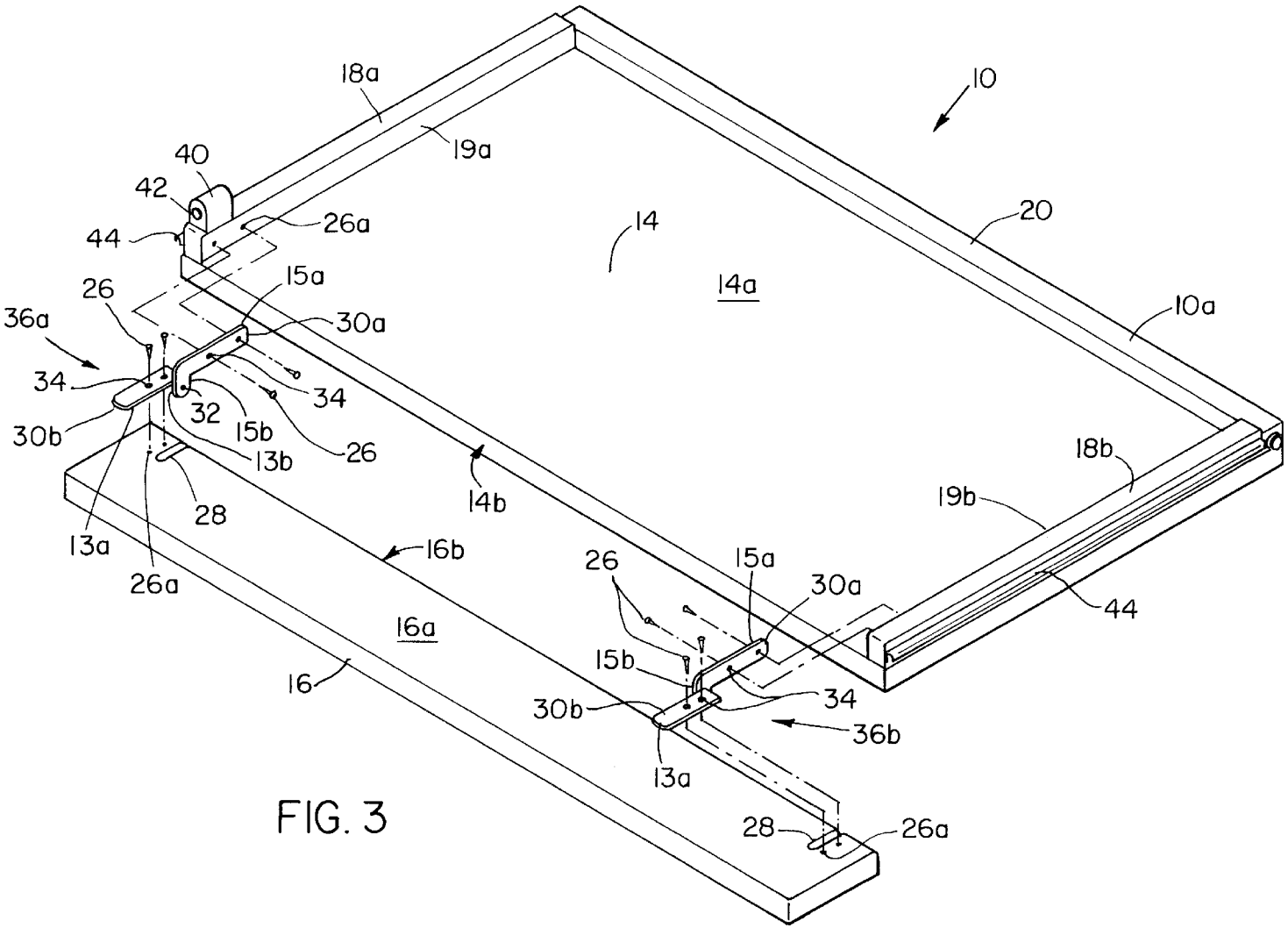
FIG. 3 is an exploded perspective view of the present invention keyboard tray assembly.
Figure 4:
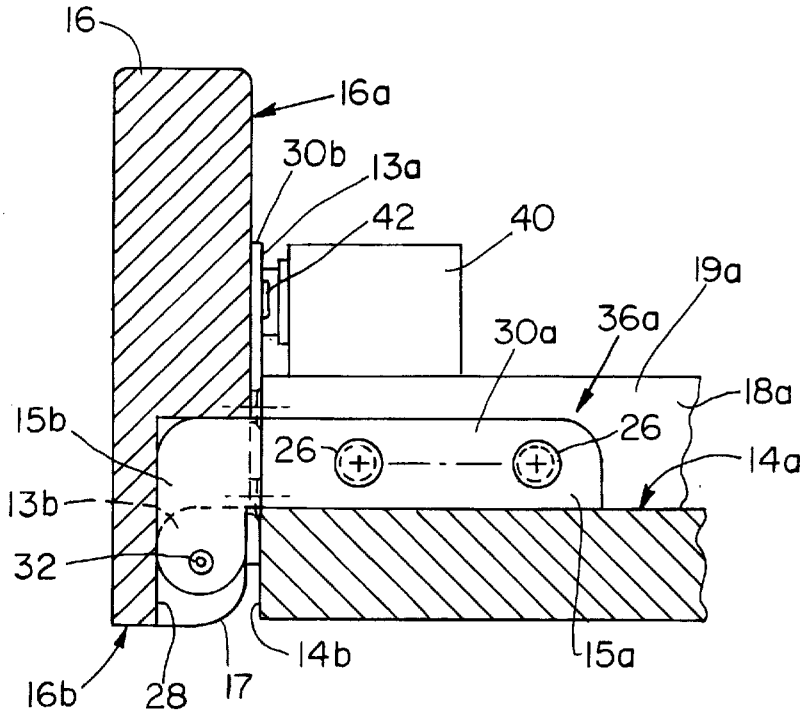
FIG. 4 is a side-sectional view of the front region of the keyboard tray assembly of FIG. 3, showing the left hand hinge, and with the front wall in the upright position.
Figure 5:
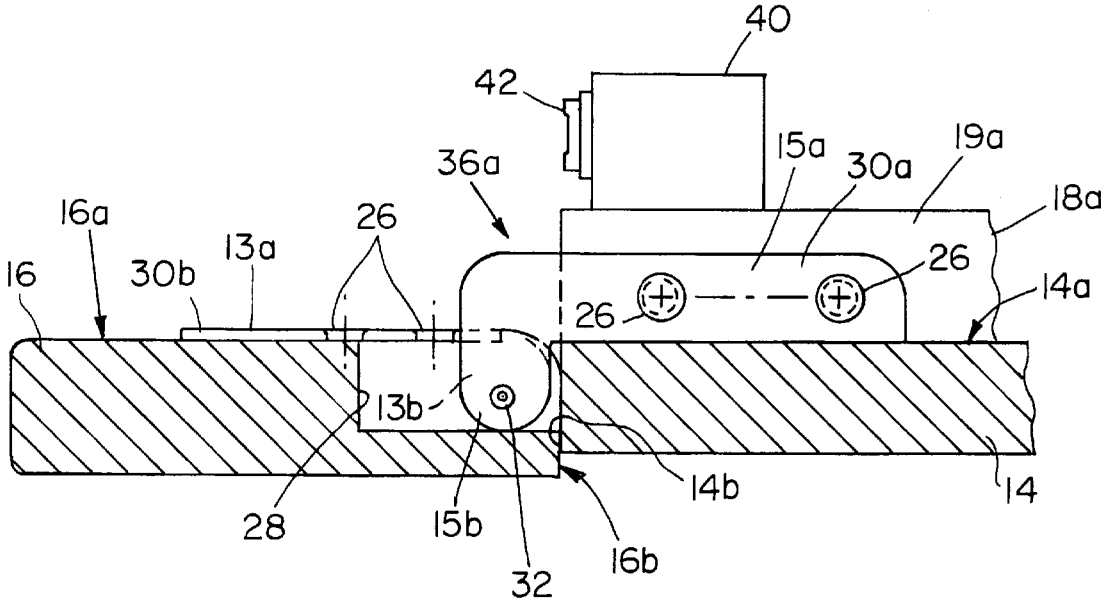
FIG. 5 is a side-sectional view of the front region of the keyboard tray assembly of FIG. 3 with the front wall lowered into a horizontal position.

Referring to FIGS. 3–6, keyboard tray assembly 10 includes a tray 10*a* having a bottom wall 14 for supporting a keyboard (not shown), two side walls 18*a*/18*b* and a rear wall 20. Walls 18*a*, 18*b* and 20 keep the keyboard, accessories and writing supplies from sliding or rolling off bottom wall 14. Tray 10*a* includes two rail assemblies 44 mounted to the exterior surfaces of side walls 18*a*/18*b* for slidably mounting keyboard tray assembly 10 to a desk. A front wall 16 is pivotably mounted to the front 14*b* of tray 10*a* by a left hand hinge 36*a* and right hand hinge 36*b*. Hinges 36*a*/36*b* have pivot points 32 which are positioned within a pair of slotted recesses in front wall 16. Front wall 16 is pivotable between an upright position (FIG. 4) and a generally horizontal position (FIG. 5). When in the upright position, front wall 16 hides and prevents the contents of tray 10*a* from falling out. When front wall 16 is lowered into the generally horizontal position, the user can access the keyboard and also use front wall 16 as a handrest.

Figure 7:
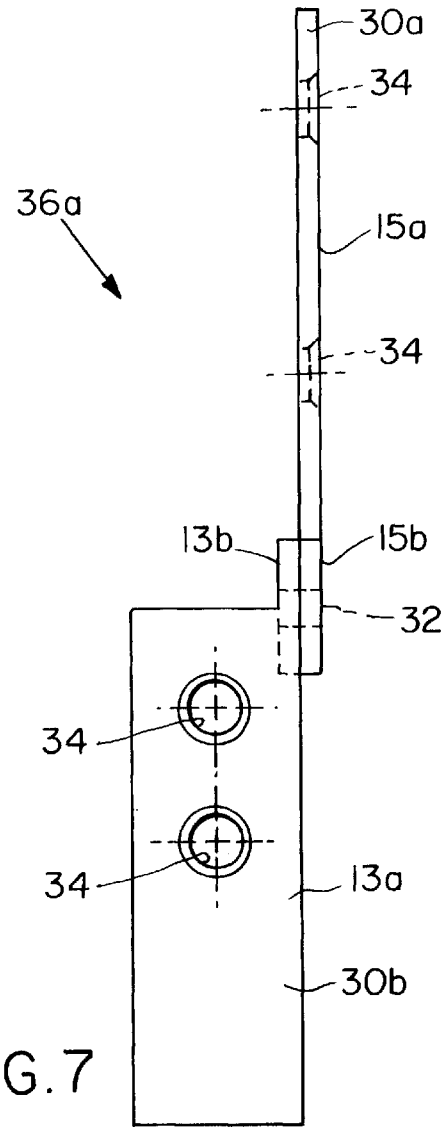
FIG. 7 is a top view of the left hand hinge.
Figure 8:
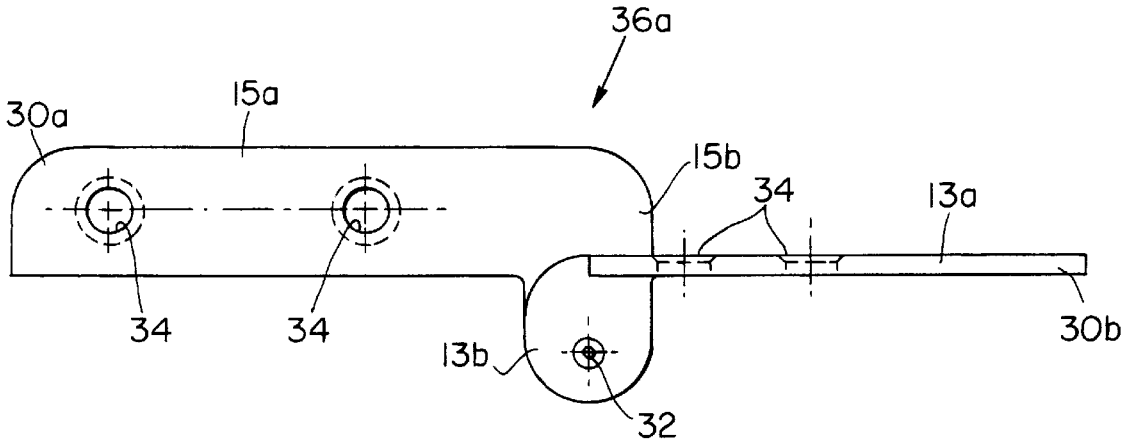
FIG. 8 is a rear side view of the left hand hinge showing the second hinge member.

Hinges 36*a* and 36*b* are similar to each other, differing in that the hinges are mirror images of each other. Referring to FIGS. 7 and 8, each hinge 36*a*/36*b* includes a first hinge member 30*a* which is rotatably coupled to a second hinge member 30*b* by pivot point 32. Each first hinge member 30*a* is flat, planar and generally "L" shaped. First hinge member 30*a* has an elongate mounting portion 15*a* and a pivot arm portion 15*b* (FIGS. 5 and 6) extending downwardly from mounting portion 15*a* at a right angle. Each second hinge member 30*b* has a flat pivot arm portion 13*b* which is rotatably coupled to pivot portion 15*b* by pivot point 32 and a flat elongate mounting portion 13*a* extending perpendicularly from pivot arm portion 13*b* on one side. The pivot arm portions 13*b*/15*b* lie along parallel planes adjacent to each other. Mounting portion 13*a* is laterally offset from pivot arm portion 13*b*. In addition, mounting portion 13*a* is also perpendicularly oriented relative to mounting portion 15*a* so that mounting portions 13*a* and 15*a* can be mounted to surfaces that are at right angles to each other. Furthermore, mounting portions 13*a*/15*a* have mounting holes 34 formed therethrough.

The mounting portions 15*a* of the first hinge members 30*a* are mounted to the interior surfaces 19*a*/19*b* of side walls 18*a*/18*b* in an upright orientation with screws 26 extending through mounting holes 34 and into holes 26*a* within side walls 18*a*/18*b* (FIGS. 3–6). The mounting portions 13*a* of the second hinge members 30*b* are mounted to the interior surface 16*a* of front wall 16 in a flat manner offset from slotted recesses 28 with screws 26 extending through mounting holes 34 and into holes 26*a* within side walls 18*a*/18*b*. The mounting portions 13*a* are located adjacent to the outer side of slotted recesses 28 (closer to the ends of front wall 16). As a result, the first hinge members 30*a* are located on the inside facing each other and the second hinge members 30*b* are on the outside. The pivot arm portions 15*b* of the first hinge members 30*a* (FIGS. 3 and 6) extend perpendicularly downwardly from the mounting portions 15*a* in front of and adjacent to the front 14*b* of bottom wall 14, and into slotted recesses 28. The pivot arm portions 13*b* of the second hinge members 30*b* extend perpendicularly from the mounting portions 13*a* into the slotted recesses 28. The pivot arm portions 13*b* extend a short distance into slotted recesses 28 from the interior surface 16*a* of front wall 16. The pivot points 32 are positioned within slotted recesses 28 at a location below the upper surface 14*a* and in front of the front 14*b* of bottom wall 14.

Figure 6:
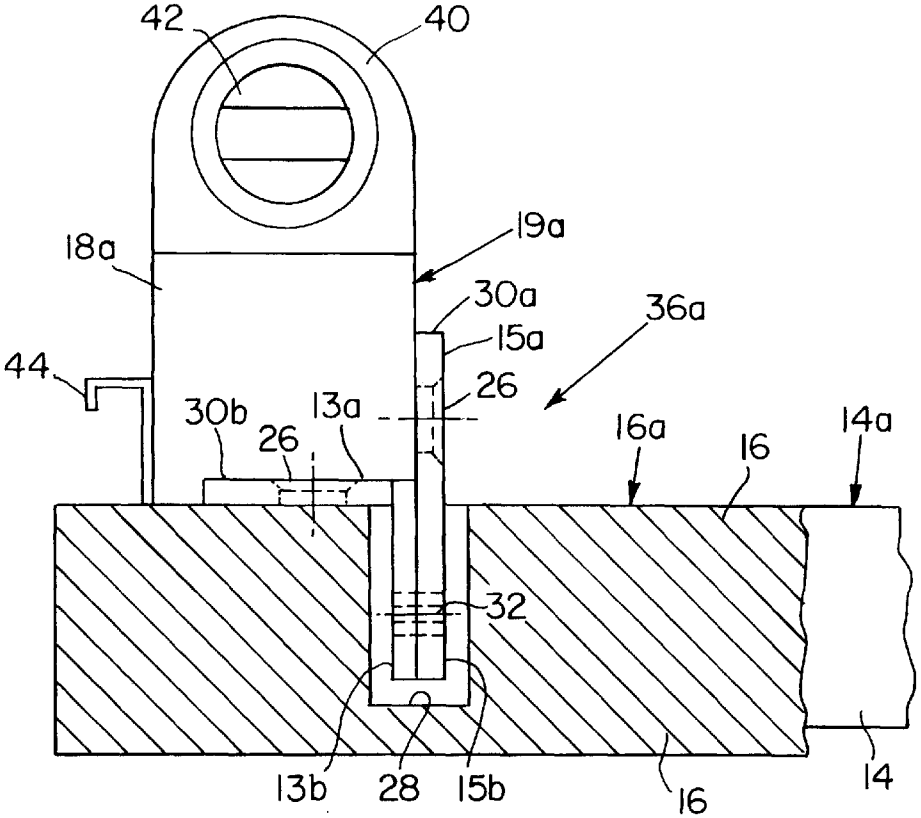
FIG. 6 is a front-sectional view of the left hand region of the keyboard tray assembly of FIG. 3 with the front wall being in cross-section and lowered into a horizontal position to show the slotted recess within the front wall.

Slotted recesses 28 extend through the interior surface 16*a* and through edge 16*b* of front wall 16. Each slotted recess 28 is sized to provide a sufficient amount of space around pivot arm portions 13*b*/15*b* to allow first hinge member 30*a* to pivot therein as well as to allow hinge member 30*a* to enter and exit slotted recess 28 (FIGS. 4–6). A radius 17 is formed on the inner edge of front wall 16 to further allow the front wall 16 to pivot closely to bottom wall 14.

Figure 9:
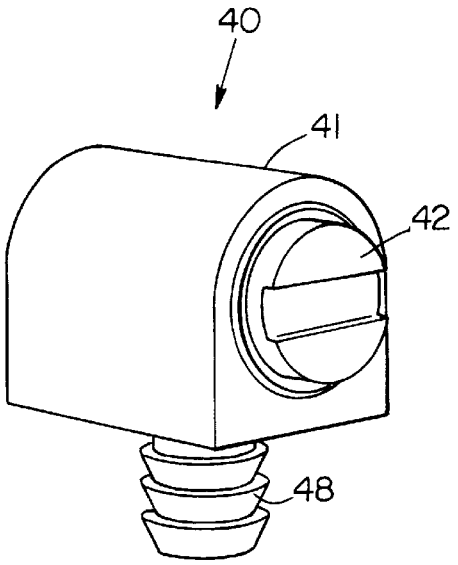
FIG. 9 is a front perspective view of the magnetic latch.
Figure 10:
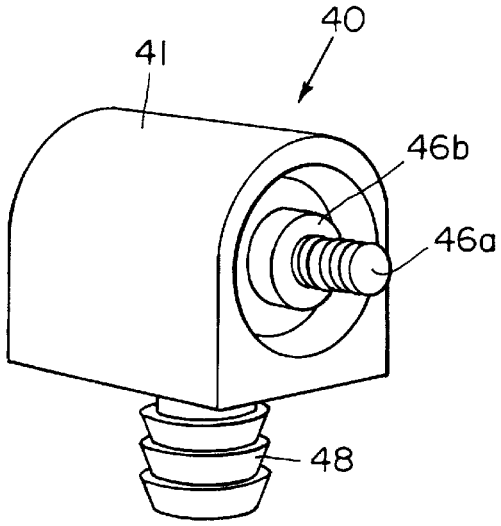
FIG. 10 is a rear perspective view of the magnetic latch.

A magnetic latch 40 for engaging the mounting portion 13*a* of the left hand hinge 36*a* is secured to the upper surface of side wall 18*a*. Referring to FIGS. 9 and 10, magnetic latch 40 includes a housing 41 with a magnet 42 protruding from the front end. Magnet 42 can be adjusted inwardly or outwardly by an adjusting screw 46*a* located at the rear end of housing 41. Once magnet 42 is in the proper position, nut 46*b* is tightened to lock magnet 42 in place. A post 48 extends downwardly from housing 41 for insertion into a hole in the top of side wall 18*a*. Post 48 includes ridges for locking post 48 therein within the hole. Although magnetic latch 40 is shown to be secured to side wall 18*a*, alternatively, magnetic latch 40 can be secured to side wall 18*b*. In addition, if desired, a magnetic latch 40 can be mounted to each side wall 18*a*/18*b*.

In use, the rail assemblies 44 of keyboard tray assembly 10 are engaged with mating slide rails mounted within a desk for slidably mounting keyboard tray assembly 10 thereto. The keyboard, mouse and mouse pad of a computer, as well as writing supplies, can then be stored within tray 10*a*. When the computer is not being used, keyboard tray assembly 10 is slid into the desk for storage. Front wall 16 is pivoted into the upright position (FIG. 4) to conceal the keyboard. The mounting portion 13*a* of hinge 36*a* engages the magnet 42 of magnetic latch 40 to latch front wall 16 in the upright position.

In order to operate the keyboard, the keyboard tray assembly 10 is slid outwardly from the desk to a position in front of the desk. The front wall 16 is then pivoted downwardly into a generally horizontal position as seen in FIG. 5 so that the user can access the keyboard. The edge 16*b* of front wall 16 engages the front 14*b* of bottom wall 14 which acts as a stop for preventing further downward movement of front wall 16. Once front wall 16 is in the lowered or down position, front wall 16 can act as a hand rest for the user when working on the keyboard. Although front wall 16 is shown to be in a horizontal position, front wall 16 may have a slight downward angle.

By positioning the pivot points 32 of hinges 36*a*/36*b* within the slotted recesses 28 of front wall 16 below the upper surface of bottom wall 14, the front wall 16 can be positioned closely to bottom wall 14 such that there is a minimal gap therebetween. The gap between front wall 16 and bottom wall 14 is small enough such that most objects stored in tray 10*a* will not fall through the gap. The slotted recesses 28 also hide the pivot points 32 from view. Securing the mounting portions 15*a* of the first hinge members 30*a* to the inner surfaces 19*a*/19*b* of side walls 18*a*/18*b* eliminates the existence of hinge surfaces on the upper surface 14*a* of bottom wall 14 and positions mounting portions 15*a* in a location that will not likely cause injury to the user. In addition, pivotably coupling the mounting portions 13*a* of the second hinge members 30*b* to the outside of the first hinge members 30*a* positions the mounting portions 13*a* in a location that will also not likely cause injury to the user. The reason is that the mounting portions 13*a* are located beyond the usable work area of tray 10*a* in front of side walls 18*a*/18*b* (FIG. 6).

The upright orientation of mounting portions 15*a* also increases the strength of hinges 36*a*/36*b*. Mounting portions 15*a* have a higher moment of inertia and as a result, are stronger when mounted in the upright orientation against side walls 18*a*/18*b* instead of being mounted flat onto bottom wall 14. Additionally, the forces exerted on mounting portions 15*a* tend to be shear forces which are perpendicular to the axes of screws 26. If mounting portions 15*a* were mounted in a flat manner onto bottom wall 14, the forces which would be exerted on mounting portions 15*a* would be tensile forces pulling on screws 26 which is undesirable.

In one preferred embodiment, keyboard tray assembly 10 has a front wall 16 that is about 3 inches high×¾ inch thick. Recesses 28 within front wall 16 are about 1¼ inches long×¼ inch wide×½ inch deep and extend through the edge 16*b* of front wall 16. Side walls 18*a*/18*b* are about ⅞ inches high and 1 inch wide. The mounting portion 15*a* of each hinge member 30*a* is about 2½ inches long×½ inch high. The pivot arm portion 15*b* extends downwardly from the mounting portion 15*a* about ½ inch. The mounting portion 13*a* of each hinge member 30*b* is about 2¼ inches long×⅝ inches wide. The pivot portion 13*b* extends at a right angle downwardly from mounting portion 13*a* about ½ inch and is ½ inch wide. The pivot point 32 is about 5/16 inch below mounting portion 13*a*. The proximal end of mounting portion 13*a* is located at a position parallel to pivot point 32 so as not to interfere with the front 14*b* of bottom wall 14 during rotation (FIGS. 4 and 5). Pivot point 32 is formed by a ⅛ inch diameter pin extending through pivot arm portions 13*b*/15*b*. Mounting holes 34 are countersunk within mounting portions 13*a*/15*a* so that the heads of screws 26 do not protrude above mounting surfaces 13*a*/15*a*.

Hinges 36*a*/36*b* are preferably made from steel about 0.075 inches thick but alternatively can be made from other suitable materials such as brass or be of other thicknesses. Although mounting portions 13*a* are preferably elongated for engagement with the magnet 42 of magnetic latch 40, alternatively, mounting portions 13*a* can be shortened and a separate metallic plate secured to the interior surface 16*a* of front wall 16 for engagement with magnetic latch 40. Bottom wall 14, side walls 18*a*/18*b*, rear wall 20 and front wall 16 are preferably made of wood, but alternatively, other suitable materials can be used such as plastics, metals or composites. If bottom wall 14 is made of a material that is thin, a thickened lip can be formed at the front end 14*b* of front wall 14 for engaging the edge 16*b* of front wall 16.

Figure 11:
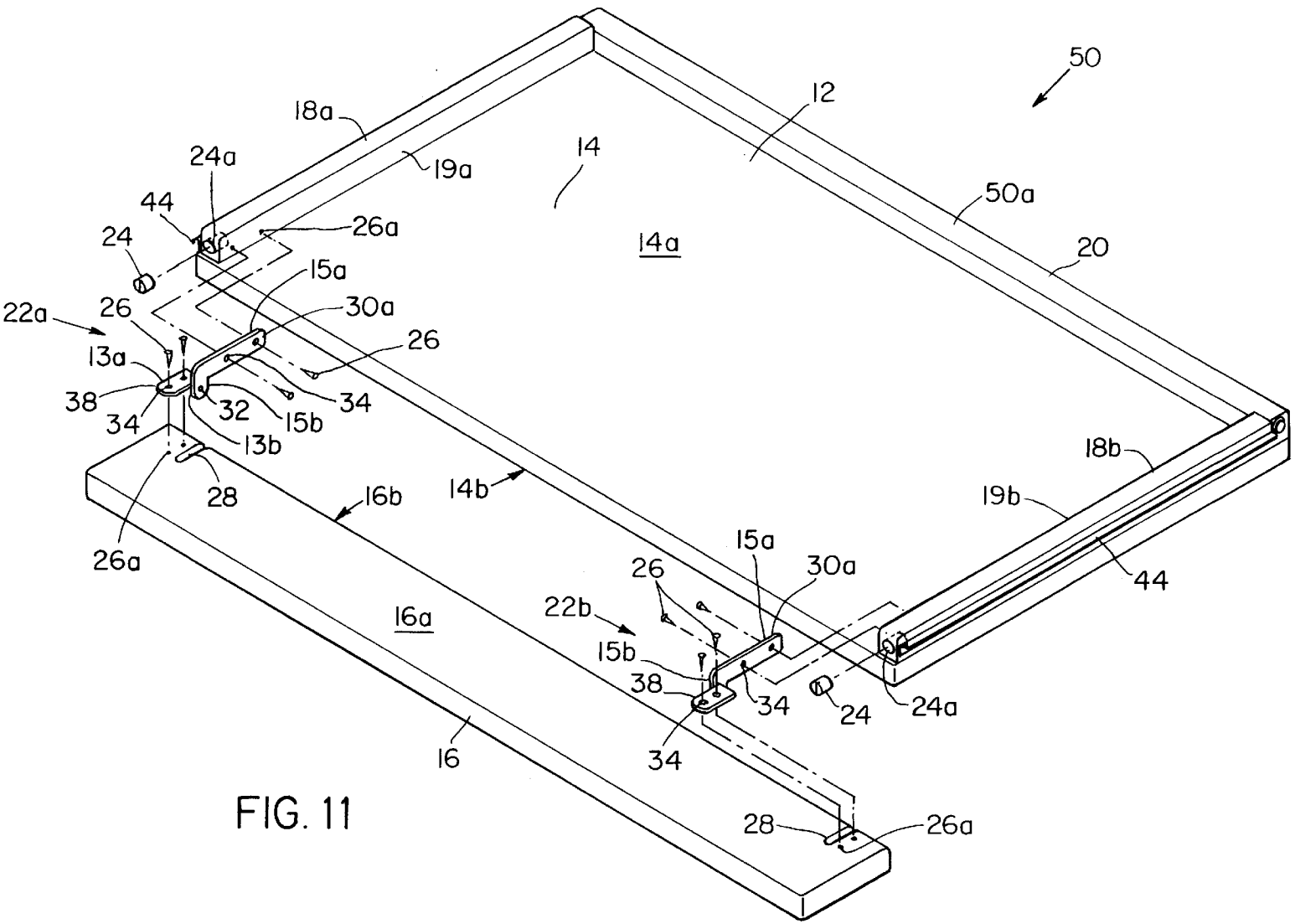
FIG. 11 is an exploded perspective view of another preferred keyboard tray assembly.
Figure 12:
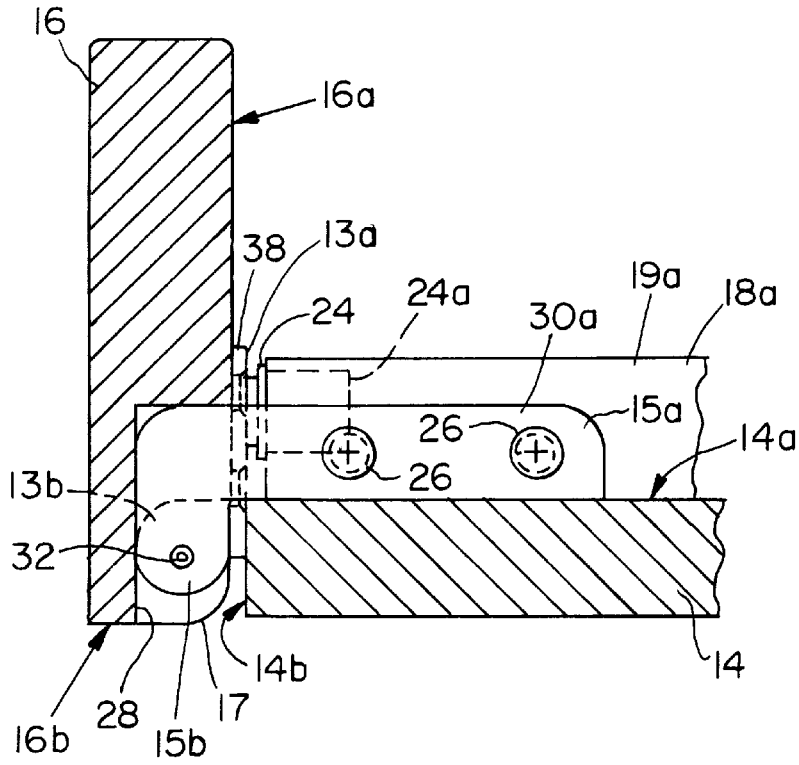
FIG. 12 is a side-sectional view of the front region of the keyboard tray assembly of FIG. 11, showing the left hand hinge, and with the front wall in the upright position.
Figure 13:
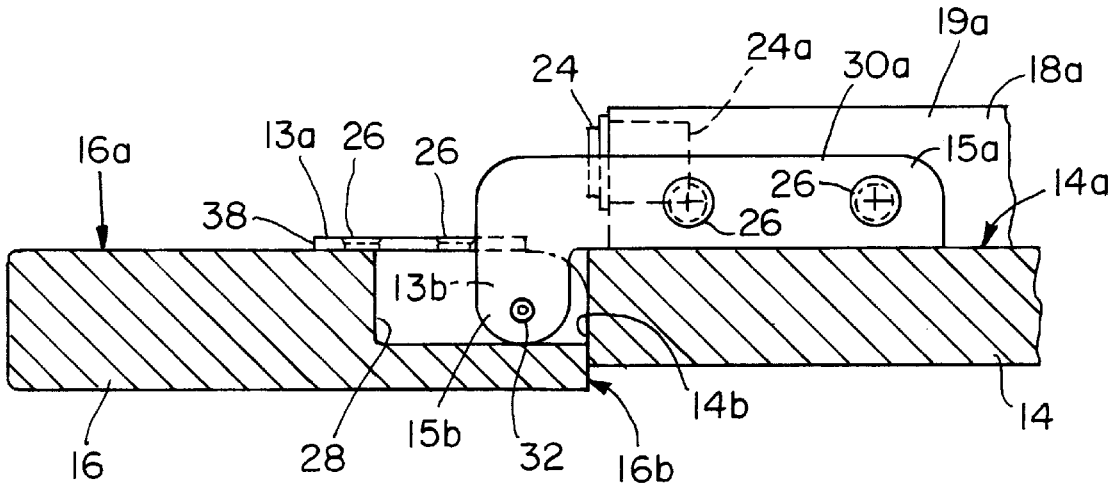
FIG. 13 is a side-sectional view of the front region of the keyboard tray assembly of FIG. 11 with the front wall lowered into a horizontal position.

Referring to FIGS. 9–11, keyboard tray assembly 50 is another preferred keyboard tray assembly which differs from keyboard tray assembly 10 in that hinges 22*a* and 22*b* have a second hinge member 38 with a short mounting portion 13*a*. Instead of employing magnetic latch 40, a pair of magnets 24 are secured within holes 24*a* in the ends of side walls 18*a* and 18*b* for magnetically engaging both second hinge members 38. Side walls 18*a* and 18*b* are set back a slight distance from the front 14*b* of bottom wall 14 so that the magnets 24 can protrude from side walls 18*a*/18*b*. Since magnets 24 are positioned closer to pivot points 32 than the magnetic latch 40 of keyboard tray assembly 10, two magnets 24 are preferably employed to provide sufficient holding power.

While this invention has been particularly shown and described with references to preferred embodiments thereof, it will be understood by those skilled in the art that various changes in form and details may be made therein without departing from the spirit and scope of the invention as defined by the appended claims.

For example, although keyboard tray assemblies 10 and 50 have been shown to include magnetic latches, alternatively, suitable mechanical latches can be employed. In addition, although hinges 36*a*/36*b* and 22*a*/22*b* have been shown to mount to surfaces 16*a* and 19*a*/19*b*, alternatively the hinges can be recessed into side walls 18*a*/18*b* and front wall 16. Furthermore, although specific dimensions have been described, such dimensions can be varied to suit particular applications. Finally, the first hinge members 30*a* can be pivotably coupled directly to front wall 16 within slotted recesses 28 by pivot pins.

What is claimed is:

1. A keyboard tray assembly comprising:

a tray having a front end, a first side wall and a bottom wall with an upper surface;

a front wall rotatably secured to the front end of the tray by a first hinge, the front wall being rotatable between an up position and a down position, the first hinge having first and second hinge members rotatably coupled together about a pivot point, the first hinge member being secured to the first side wall of the tray and the second hinge member being secured to the front wall, the first hinge being shaped to position the pivot point adjacent to the front end of the tray below the upper surface of the bottom wall and within a first recess in the front wall, thereby allowing the front wall to pivot in close relationship to the front end of the tray, the recess being configured to provide space around the pivot point so as not to engage with the pivot point; and a latching member for latching the front wall in the up position.

2. The assembly of claim 1 further comprising:

a second side wall opposite to the first side wall of the tray; and a second hinge spaced apart from the first hinge having first and second hinge members rotatably coupled together about a pivot point, the first hinge member of the second hinge being secured to the second side wall and the second hinge member of the second hinge being secured to the front wall, the second hinge being shaped to position the pivot point of the second hinge adjacent to the front end of the tray below the upper surface of the bottom wall and within a second recess in the front wall.

3. The assembly of claim 1 in which the front end of the tray acts as a stop for the front wall when the front wall is in the down position.

4. The assembly of claim 1 further comprising a second hinge spaced apart from the first hinge, the second hinge having first and second hinge members rotatably coupled together about a pivot point, the first hinge member of the second hinge being secured to the tray and the second hinge member of the second hinge being secured to the front wall, the second hinge being shaped to position the pivot point of the second hinge adjacent to the front end of the tray below the upper surface of the bottom wall and within a second recess in the front wall.

5. The assembly of claim 1 in which the first and second hinge members have mounting surfaces which are at right angles to each other.

6. The assembly of claim 5 in which the first side wall and the front wall each have an interior surface, the first recess in the front wall extending through the interior surface of the front wall, the mounting surface of the first hinge member being secured to the interior surface of the first side wall and the mounting surface of the second hinge member being secured to the interior surface of the front wall adjacent to the first recess.

7. The assembly of claim 6 in which the first and second hinge members each have an arm extending below the upper surface of the bottom wall into the first recess of the front wall, the arms being rotatably coupled together about the pivot point.

8. The assembly of claim 1 in which the latching member comprises a magnet secured to the front end of the tray for magnetically engaging a metallic member on the front wall.

9. The assembly of claim 8 in which the magnet is secured to the first side wall and the second hinge member includes the metallic member.

10. The assembly of claim 8 in which the magnet is secured on top of the first side wall.

11. A keyboard tray assembly comprising:

a tray having a front end, a bottom wall with an upper surface, and opposed first and second side walls;

a front wall rotatably secured to the front end of the tray by first and second hinges, the front wall being rotatable between an up position and a down position, the first and second hinges each having first and second hinge members rotatably coupled together about a pivot point, each first hinge member being secured to one of the side walls and each second hinge member being secured to the front wall, the first and second hinges being shaped to position the pivot points adjacent to the front end of the tray below the upper surface of the bottom wall and within respective first and second recesses of the front wall, thereby allowing the front wall to pivot in close relationship to the front end of the tray, the recesses being configured to provide space around the pivot points so as not to engage with the pivot points; and a latching member for latching the front wall in the up position.

12. The assembly of claim 11 in which the latching member comprises a magnet secured to the first side wall for magnetically engaging the second hinge member of the first hinge.

13. The assembly of claim 12 in which the front end of the tray acts as a stop for the front wall when the front wall is in the down position.

14. A keyboard tray assembly comprising:

a tray having a front end, a first side wall with an interior surface and a bottom wall with an upper surface; and a front wall rotatably secured to the front end of the tray by a first hinge, the front wall having an interior surface and a first recess extending therethrough, the front wall being rotatable between an up position and a down position, the first hinge having first and second hinge members rotatable coupled together about a pivot point with mounting surfaces which are at right angles to each other, the mounting surface of the first hinge member being secured to the interior surface of the first side wall of the tray and the mounting surface of the second hinge member being secured to the interior surface of the front wall adjacent to the first recess, the first hinge being shaped to position the pivot point adjacent to the front end of the tray below the upper surface of the bottom wall and within the first recess in the front wall, thereby allowing the front wall to pivot in close relationship to the front end of the tray, the first and second hinge members each having an arm extending below the upper surface of the bottom wall into the first recess, the arms being rotatably coupled together about the pivot point, the recess being configured to provide space around the pivot point so as not to engage with the pivot point.

15. A keyboard tray assembly comprising:

a tray having a front end and a bottom wall with an upper surface; and a front wall rotatably secured to the front end of the tray by a first hinge, the front wall being rotatable between an up position and a down position, the first hinge having first and second hinge members each with an arm, the arms of the first and second hinge members being rotatably coupled together about a pivot point, the first hinge member being secured to the tray and the second hinge member being secured to the front wall, the arm of the first hinge member extending downwardly to a position adjacent to the front end of the tray below the upper surface of the bottom wall and within a first recess in the front wall, and the arm of the second hinge member extending from the front wall into the recess, thereby positioning the pivot point within the recess and allowing the front wall to pivot in close relationship to the front end of the tray, the recess being configured to provide space around the pivot point so as not to engage with the pivot point.

16. A method of forming a keyboard tray assembly comprising:

providing a tray having a front end, a first side wall having an interior surface and a bottom wall with an upper surface;

rotatably securing a front wall to the front end of the tray with a first hinge, the front wall having an interior surface and a first recess extending therethrough, the front wall being rotatable between an up position and a down position, the first hinge having first and second hinge members rotatably coupled together about a pivot point with mounting surfaces which are at right angles to each other, the mounting surface of the first hinge member being secured to the interior surface of the first side wall of the tray and the mounting surface of the second hinge member being secured to the interior surface of the front wall adjacent to the first recess; and shaping the first hinge to position the pivot point adjacent to the front end of the tray below the upper surface of the bottom wall and within the first recess of the front wall, thereby allowing the front wall to pivot in close relationship to the front end of the tray, the first and second hinge members each having an arm extending below the upper surface of the bottom wall into the first recess, the arms being rotatable coupled together about the pivot point, the recess being configured to provide space around the pivot point so as not to engage with the pivot point.

17. The method of claim 16 further comprising the step of providing a latching member for latching the front wall in the up position.

18. The method of claim 17 further comprising the step of providing the latching member with a magnet secured to the front end of the tray for magnetically engaging a metallic member on the front wall.

19. The method of claim 18 further comprising the step of securing the magnet to the first side wall for magnetically engaging the second hinge member.

20. The method of claim 18 further comprising the step of securing the magnet on top of the first side wall.

21. The method of claim 16 further comprising the steps of:

providing a second hinge spaced apart from the first hinge, the second hinge having first and second hinge members rotatably coupled together about a pivot point, the first hinge member of the second hinge being secured to the tray and the second hinge member of the second hinge being secured to the front wall; and shaping the second hinge to position the pivot point of the second hinge adjacent to the front end of the tray below the upper surface of the bottom wall and within a second recess in the front wall.

22. The method of claim 16 further comprising the steps of:

providing the tray with a second side wall opposite to the first side wall; and providing a second hinge spaced apart from the first hinge, the second hinge having first and second hinge members rotatably coupled together about a pivot point, the first hinge member of the second hinge being secured to the second side wall and the second hinge member of the second hinge being secured to the front wall; and shaping the second hinge to position the pivot point of the second hinge adjacent to the front end of the tray below the upper surface of the bottom wall and within a second recess in the front wall.

23. A keyboard tray assembly comprising:

a tray having a front end, a first side wall having an interior surface and a bottom wall with an upper surface; and a front wall rotatably secured to the front end of the tray by a first hinge, the front wall having an interior surface and a first recess extending therethrough, the front wall being rotatable between an up position and a down position, the first hinge having first and second hinge members rotatably coupled together about a pivot point with mounting surfaces which are at right angles to each other, the mounting surface of the first hinge member being secured to the interior surface of the first side wall of the tray and the mounting surface of the second hinge member being secured to the interior surface of the front wall adjacent to the first recess, the first hinge being shaped to position the pivot point adjacent to the front end of the tray below the upper surface of the bottom wall and within the first recess in the front wall, thereby allowing the front wall to pivot in close relationship to the front end of the tray, whereby said front wall is adapted to lie substantially co-planar with the bottom wall of said tray, the first and second hinge members each having an arm extending below the upper surface of the bottom wall into the first recess of the front wall, the arms being rotatably coupled together about the pivot point.

24. A method of forming a keyboard tray assembly comprising:

providing a tray having a front end, a first side wall and a bottom wall with an upper surface; and rotatably securing a front wall to the front end of the tray with a first hinge, the front wall being rotatable between an up position and a down position, the front wall and the first side wall each having an interior surface, the first hinge having first and second hinge members rotatably coupled together about a pivot point, the first hinge member being secured to the first side wall of the tray and the second hinge member being secured to the front wall, the first and second hinge members having mounting surfaces which are at right angles to each other, the mounting surface of the first hinge member being secured to the interior surface of the first side wall; and shaping the first hinge to position the pivot point adjacent to the front end of the tray below the upper surface of the bottom wall and within a first recess of the front wall, the first recess extending through the interior surface of the front wall, the mounting surface of the second hinge member being secured to the interior surface of the front wall adjacent to the first recess, thereby allowing the front wall to pivot in close relationship to the front end of the tray, the first and second hinge members each having an arm extending below the upper surface of the bottom wall into the first recess, the arms being rotatable coupled together about the pivot point.

25. A method of forming a keyboard tray assembly comprising:

providing a tray having a front end, a first side wall and a bottom wall with an upper surface;

rotatably securing a front wall to the front end of the tray by a first hinge, the front wall being rotatable between an up position and a down position, the first hinge having first and second hinge members rotatably coupled together about a pivot point, the first hinge member being secured to the first side wall of the tray and the second hinge member being secured to the front wall;

shaping the first hinge to position the pivot point adjacent to the front end of the tray below the upper surface of the bottom wall and within a first recess in the front wall, thereby allowing the front wall to pivot in close relationship to the front end of the tray, the recess being configured to provide space around the pivot point so as not to engage with the pivot point; and providing a latching member for latching the front wall in the up position.

* * * * *

UNITED STATES PATENT AND TRADEMARK OFFICE

CERTIFICATE OF CORRECTION

PATENT NO. : 6,152,411
DATED : November 28, 2000
INVENTOR(S) : Donald A. Lundstrom It is certified that error appears in the above-identified patent and that said Letters Patent is hereby corrected as shown below:

Claim 14, column 7, line 3, delete "rotatable" and insert --rotatably--.
Claim 16, column 8, line 59, delete "rotatable" and insert --rotatably--.
Claim 24, column 10, line 34, delete "rotatable" and insert --rotatably--.

Signed and Sealed this

Eighth Day of May, 2001

*Attest:*

Nicholas P. Godici

NICHOLAS P. GODICI

*Attesting Officer*

*Acting Director of the United States Patent and Trademark Office*